US008993908B2

(12) United States Patent
Serpinet et al.

(10) Patent No.: US 8,993,908 B2
(45) Date of Patent: Mar. 31, 2015

(54) MOVING CONTACT-CARRYING CARRIAGE AND ELECTRICAL CUT-OFF DEVICE EQUIPPED WITH SUCH CARRIAGE

(75) Inventors: Marc Serpinet, Sundhouse (FR); Yves Trichard, Colmar (FR); Arnaud Marchal, Ebersheim (FR)

(73) Assignee: Socomec S.A., Benfeld (FR)

( * ) Notice: Subject to any disclaimer, the term of this patent is extended or adjusted under 35 U.S.C. 154(b) by 76 days.

(21) Appl. No.: 13/598,831

(22) Filed: Aug. 30, 2012

(65) Prior Publication Data

US 2013/0056337 A1 Mar. 7, 2013

(30) Foreign Application Priority Data

Sep. 1, 2011 (FR) ..... 11 57714

(51) Int. Cl.
*H01H 1/20* (2006.01)
*H01H 9/00* (2006.01)
*H01H 71/56* (2006.01)

(52) U.S. Cl.
CPC ..... *H01H 9/0066* (2013.01); *H01H 1/2083* (2013.01); *H01H 71/56* (2013.01)
USPC ..... 200/243

(58) Field of Classification Search
USPC ..... 200/293, 296, 297, 5 R, 5 B, 5 C, 6 R, 200/19.18, 19.2, 19.22, 19.27, 19.3, 49, 200/553, 558, 339, 243
See application file for complete search history.

(56) References Cited

U.S. PATENT DOCUMENTS 2,356,040 A 8/1944 Ellis et al.
3,319,199 A 5/1967 Bauer
4,633,207 A 12/1986 McClellan et al.
5,794,763 A * 8/1998 Ogasawara ..... 200/401

(Continued)

FOREIGN PATENT DOCUMENTS

BE 661 103 7/1965
DE 741 311 11/1943

(Continued)

OTHER PUBLICATIONS

French Search Report Corresponding to FR 11/57712.

(Continued)

*Primary Examiner* — Edwin A. Leon
*Assistant Examiner* — Anthony R. Jimenez
(74) *Attorney, Agent, or Firm* — Davis & Bujold, PLLC; Michael J. Bujold

(57) ABSTRACT

A moving contact-carrying carriage (8) for an electrical cut-off device which comprises several seats (80) arranged for receiving several parallel moving contacts (5A-5C) offset in space, and each of them is associated with a return mechanism (65). The carriage can be coupled with an actuator mechanism (6) of the device. The carriage (8) comprises an insulating support (81) which has parallel seats (80) and a supporting structure (9), surrounding the insulating support (81), for forming a load-absorbing belt therearound. In order to couple the carriage (8) with the actuator mechanism, the supporting structure (9) comprises a connecting part (91) positioned in a front section of the insulating support (81) and passing through the central seat (80) and resting against the central moving contact (5A), on a side opposite to the return mechanism (65), for directly transmitting driving efforts of the actuator mechanism when opening the electrical circuit.

19 Claims, 3 Drawing Sheets

(56) References Cited

U.S. PATENT DOCUMENTS

| | | | | |
|---|---|---|---|---|
| 2003/0038695 | A1 | 2/2003 | Kramer | |
| 2008/0087535 | A1 * | 4/2008 | Rakus et al. | 200/558 |
| 2010/0026427 | A1 | 2/2010 | Moeller et al. | |

FOREIGN PATENT DOCUMENTS

| | | | | |
|---|---|---|---|---|
| DE | 741311 | * | 11/1943 | |
| DE | WO2005/069336 | * | 7/2005 | H01H 71/52 |
| EP | 0 199 668 | A2 | 10/1986 | |
| EP | 0 473 014 | A2 | 3/1992 | |
| EP | 1 026 710 | A2 | 8/2000 | |
| EP | 1 085 610 | A1 | 3/2001 | |
| FR | 2 188 292 | | 1/1974 | |
| FR | 2 383 513 | A1 | 10/1978 | |
| FR | 2 524 195 | A1 | 3/1982 | |
| FR | 2 516 699 | A1 | 5/1983 | |
| FR | 2 638 017 | A1 | 4/1990 | |
| FR | 2 756 412 | A1 | 5/1998 | |
| FR | 2818434 | A1 | 6/2002 | |
| FR | 2 891 395 | A1 | 3/2007 | |
| GB | 2 096 396 | A | 10/1982 | |
| GB | 2 384 626 | A | 7/2003 | |
| WO | 2006/137687 | A1 | 12/2006 | |
| WO | 2007/036624 | A1 | 4/2007 | |

OTHER PUBLICATIONS

French Search Report Corresponding to FR11/57713.
French Search Report Corresponding to FR11/57714.

* cited by examiner

MOVING CONTACT-CARRYING CARRIAGE AND ELECTRICAL CUT-OFF DEVICE EQUIPPED WITH SUCH CARRIAGE

This application claims priority from French patent application serial no. 11/57714 filed Sep. 1, 2011.

FIELD OF THE INVENTION

The present invention relates to a moving contact-carrying carriage for an electrical cut-off device, said carriage comprising at least one seat arranged to receive a moving contact associated with a return means, and said carriage being intended to be coupled with an actuator mechanism belonging to said device.

The invention also relates to an electrical cut-off device provided with a control module associated with at least one cut-off module corresponding to a phase of an electrical network, this cut-off module including at least one moving contact associated with at least one pair of fixed contacts, said moving contact being carried by a carriage coupled with an actuator mechanism controlled by said control module so as to be moved between at least one switched-off position in which the moving contact is distant from the fixed contacts and the electrical circuit is open, and a switched-on position in which the moving contact is resting on the fixed contacts and the electrical circuit is closed.

BACKGROUND OF THE INVENTION

To move the moving contacts from the open or switched-off position to the closed or switched-on position in electrical cut-off devices such as switches, fuse switches, commutators, reversing switches, circuit breakers or similar appliances, the moving contacts are arranged on or carried by a carriage. This carriage is generally made of a single molded or injection-molded part out of synthetic or composite material and is used to operate simultaneously the moving contacts of the different cut-off modules that equip a same cut-off device in function of the number of phases of the electrical network. The whole of the constraints suffered by the carriage, such as heating, continuous mechanical stress, occasional high-intensity mechanical stress, etc., lead inevitably to deformations or even breakages of the carriage. Switching several phases with a same moving carriage also poses insulation problems between the phases. These various constraints limit the technical performances of such a carriage.

SUMMARY OF THE INVENTION

The present invention aims to remedy these disadvantages by offering a new design for a moving contact-carrying carriage that can be fitted on any kind of electrical cut-off device in which the moving contacts are closed by pressing them on the fixed contacts, this carriage being arranged to bear without deformation both continuous mechanical stress under high temperature conditions, for example of the order of 100° C., and exceptional mechanical stress, in particular in case of contact areas welding, in order to increase the electrodynamic and mechanical endurance of the electrical cut-off device equipped with such carriage.

To that purpose, the invention relates to a carriage of the kind indicated in the preamble, characterized in that it comprises at least one insulating support comprising said seat and at least one supporting structure surrounding said insulating support so as to form around it a load-absorbing belt.

The supporting structure comprises advantageously at least one connecting part intended for coupling said carriage with the actuator mechanism belonging to said device, this connecting part being preferably positioned in a front section of said insulating support and passing transversally through said seat in order to rest on the moving contact on the side opposite to its return means when said moving contact is mounted in said carriage.

In a preferred embodiment, the supporting structure comprises furthermore a metallic profile extending over the lateral sides and on the rear of said insulating support and the connecting part comprises at least one metallic shaft passing through said insulating support and the side ends of said metallic profile.

The insulating support can comprise at least two superposed parts, among which a body in which said moving contact is seated, and a base in which said return means is seated at least partly, said seat extending from said body to said base.

In the preferred embodiment, the carriage comprises several seats arranged in parallel to accommodate several moving contacts insulated from each other, these seats can have different depths so as to offset said moving contacts in space.

If the carriage is symmetrical with respect to a centerline, then the seats are offset two by two symmetrically with respect to said centerline so as to form stages.

Also to that purpose, the invention relates to a cut-off device of the kind indicated in the preamble, characterized in that said carriage comprises at least one insulating support comprising said seat and at least one supporting structure surrounding said insulating support so as to form around it a load-absorbing belt, as defined above.

BRIEF DESCRIPTION OF THE DRAWINGS

The present invention and its advantages will be better revealed in the following description of an embodiment given as a non limiting example, in reference to the drawings in appendix, in which.

DETAILED DESCRIPTION OF THE PREFERRED EMBODIMENTS

Figure 1:
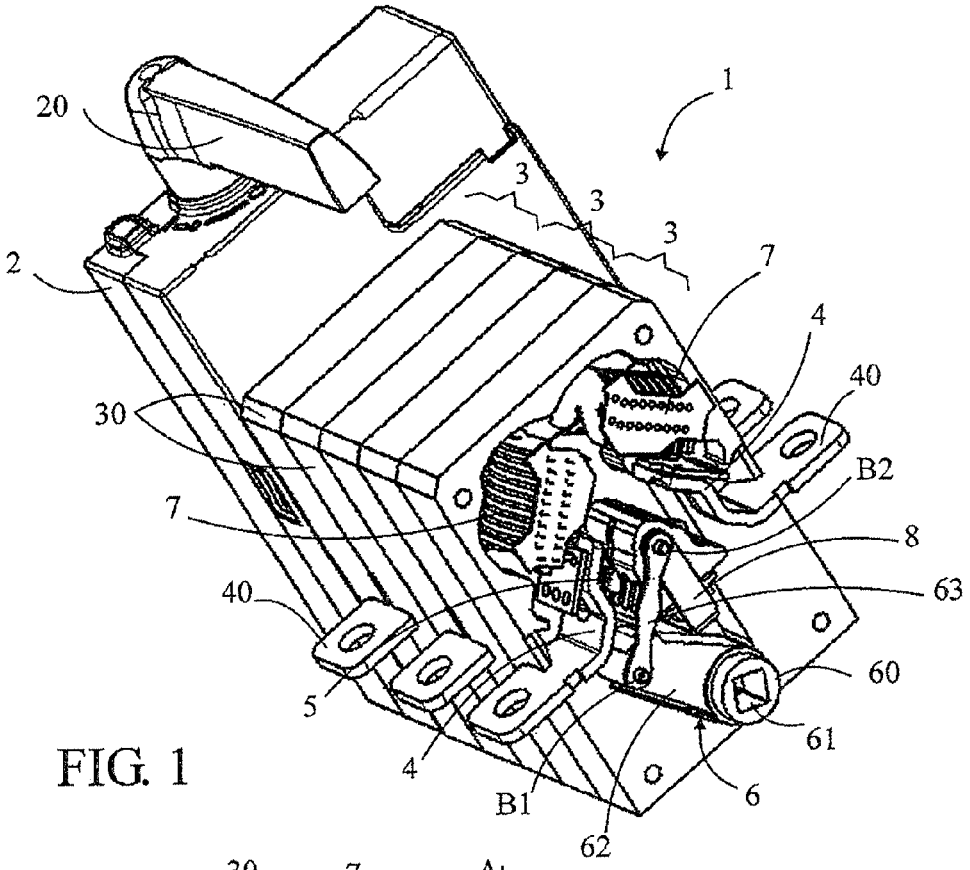
FIG. 1 is a perspective view of an example of an electrical cut-off device according to the invention comprising a control module associated with three cut-off modules, in which the last cut-off module is open.

Referring to FIG. 1, the electrical cut-off device 1 object of the invention is usually made of a control module 2 associated with one or several cut-off modules 3 corresponding each to a phase of an electrical network. In the illustrated example, the device 1 is a three-phase device and comprises three cut-off modules 3. Each cut-off module 3 comprises in a known manner an insulating housing 30 inside of which at least two fixed contacts 4 forming a pair are seated, extending outside of said housing by means of connection terminals 40, and at least one moving contact 5 carried by a carriage 8 coupled with an actuator mechanism 6 controlled by the control module 2 in order to be moved between at least one switched-off position in which it is distant from the fixed contacts and the electrical circuit is open, and a switched-on position in which it is resting on the fixed contacts and the electrical circuit is closed. The control module 2 may be actuated manually by means of a handle 20 and/or automatically by means of a motorization (not represented). In the represented example, the cut-off device 1 comprises splitting chambers 7 located above the fixed contacts 4 and the moving contact 5 to capture, stretch, cool down and extinguish the electric arc generated by the current at every status change of said device.

This cut-off device 1 must be able to establish and cut off currents I called normal or fault currents having a value from 0 to 10 In, In being the value of the rated current that can flow continuously through the device. This device must also be able to establish and if necessary cut off short-circuit currents whose value that can reach 100 to 300 times the rated current In, without breakage or deformation of the carriage 8.

Figure 2:
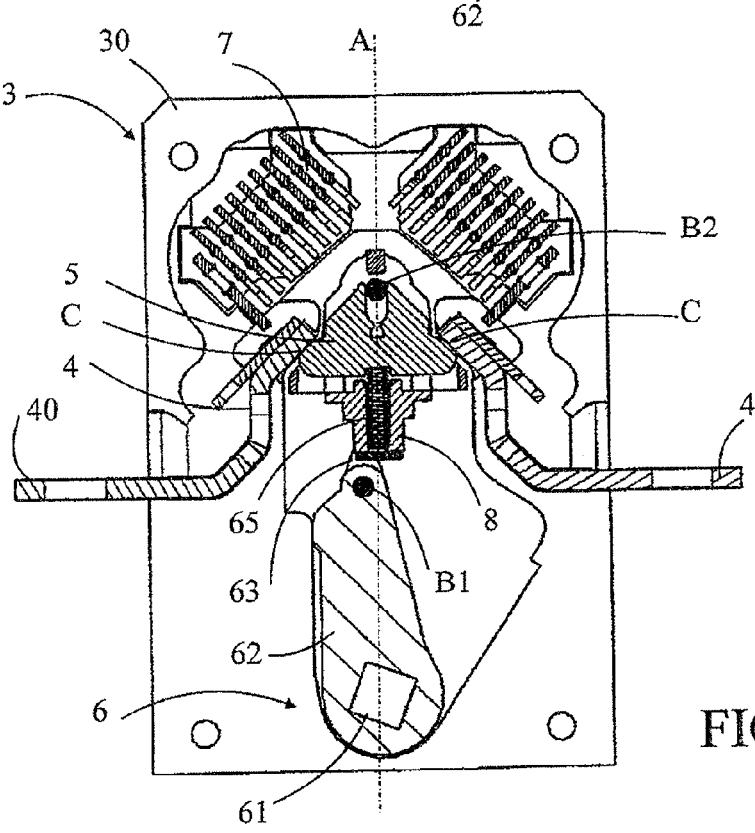
FIG. 2 is a cross-sectional view of a cut-off module of the device of FIG. 1 in switched-on position.

The solution of the invention is described in reference to an electrical device 1 whose cut-off modules have a specific internal architecture, which is the subject of another patent application filed simultaneously, but it can of course apply to any internal architecture according to the state of the art. In the example represented in FIGS. 1 and 2, the fixed contacts 4 and the moving contact 5 are arranged to form a current loop having an omega shape that is symmetrical with respect to a centerline A merged with the displacement axis Fd of the moving contact 5, in which the Laplace forces, also called compensation efforts Fc, generated by the current circulating in the current loop, are acting. The conductive parts that form the fixed contacts 4 are rigidly attached to the housing 30, bent substantially with an S-shape, arranged in opposition and separated by a free central space. The conductive part that forms the moving contact 5 has a width larger than the free space between the two fixed contacts 4 in order, in the switched-on position, to be pressed against the fixed contacts 4. Each of these conductive parts has a contact area C located in a plane inclined with respect to the centerline A.

Figure 3:
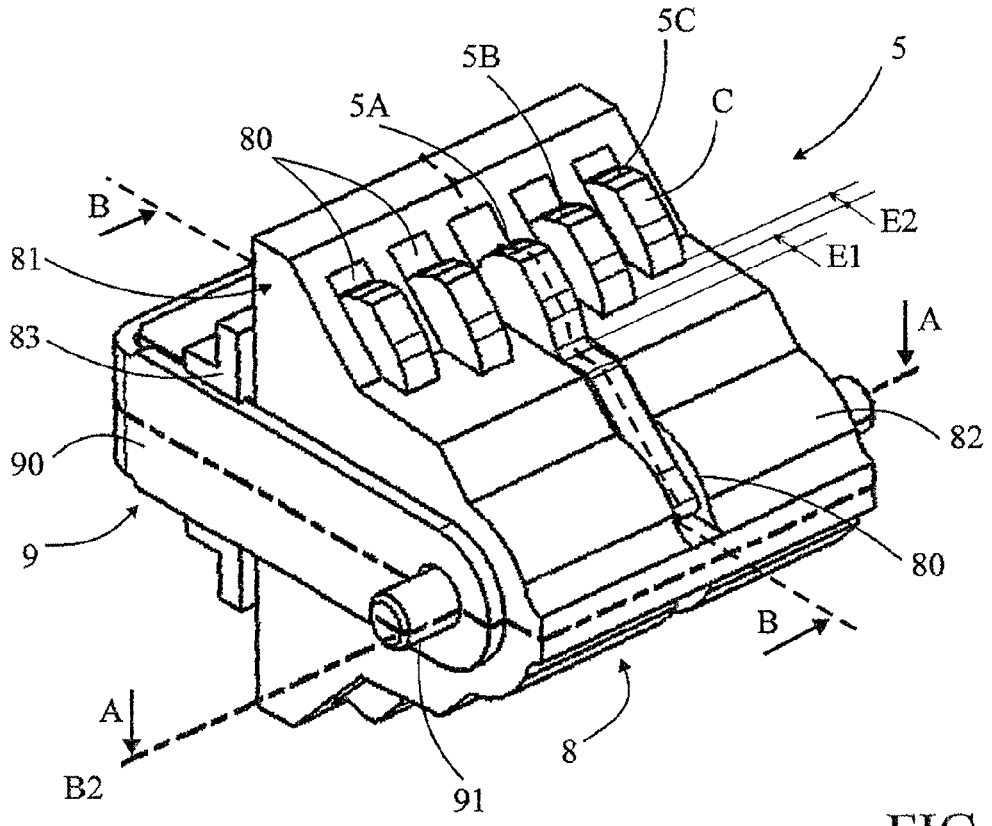
FIG. 3 is a perspective view of a moving contact-carrying carriage entering in the design of the device of FIG. 1, FIGS. 4A and 4B are cross-sectional views of the carriage of FIG. 3, respectively along the AA and BB section axes.
Figure 4A:
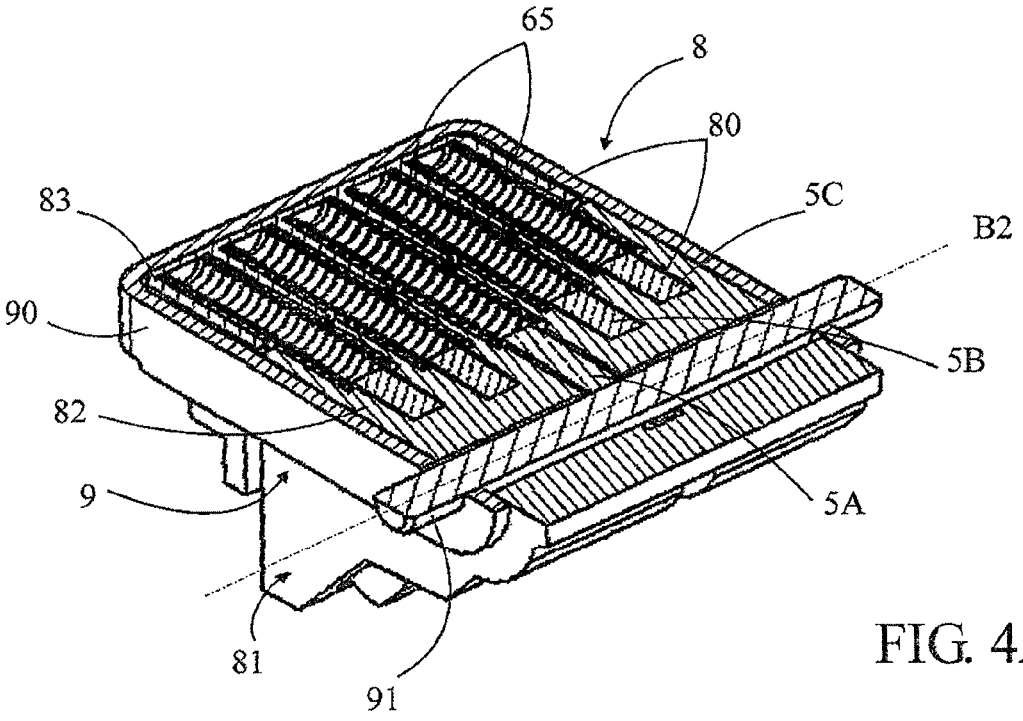
Figure 4B:
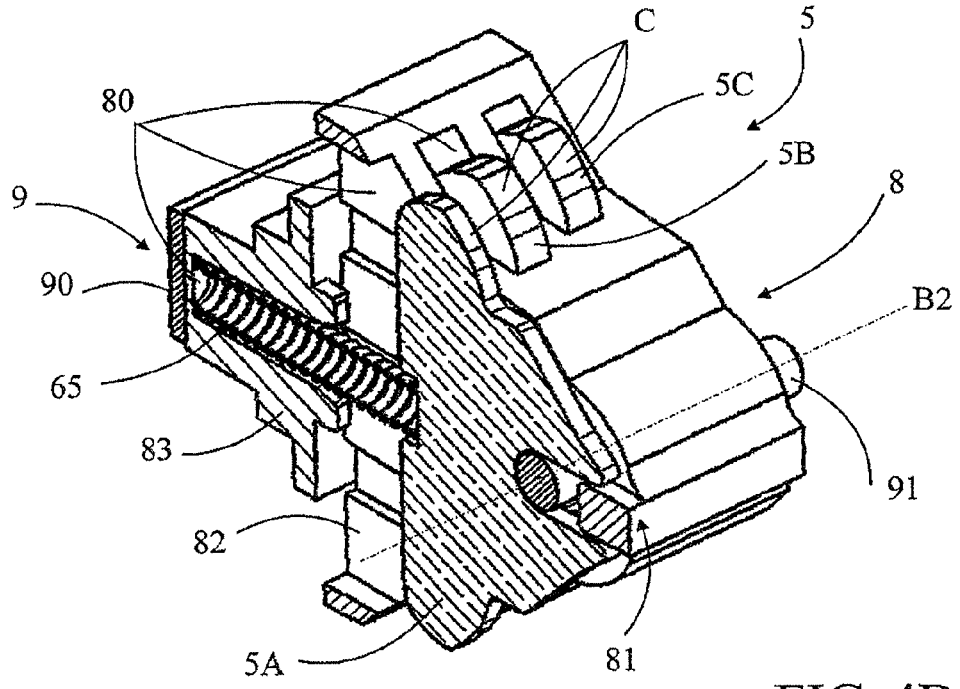
Figure 5:
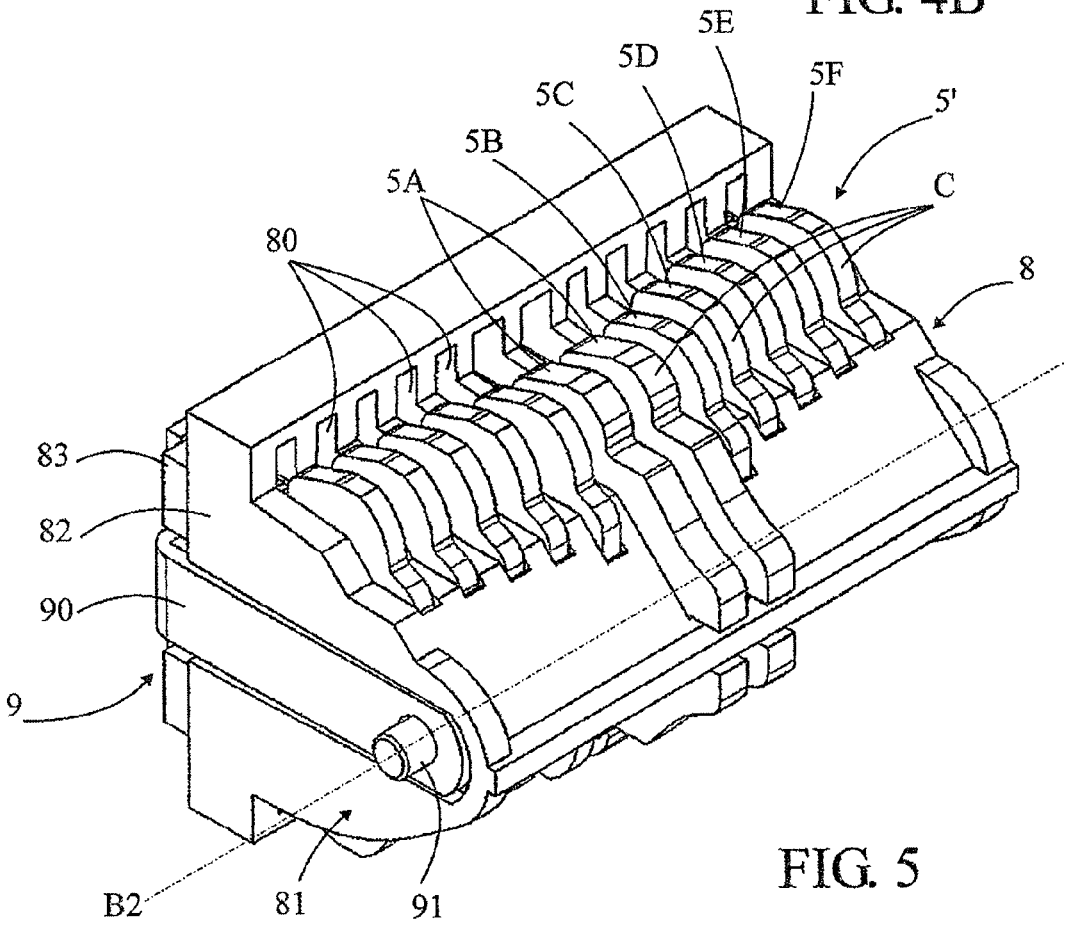
FIG. 5 is an embodiment variant of the carriage of FIG. 3 corresponding to a higher current rating.

The solution of the invention is also described in reference to an electrical device whose moving contact is in fact made of a set 5, 5' of several parallel moving contacts 5A-C, 5A-F offset in space allowing to stagger in time the approach of the moving contacts on the fixed contacts 4, which is also the subject of another patent application filed simultaneously, but it can of course apply to the devices according to the state of the art comprising one or several moving contacts for each pair of fixed contacts. In the example represented in FIGS. 1 and 2, the number of moving contacts per set depends on the rating of the rated current In. FIGS. 3 and 5 illustrate two embodiment variants of a set of moving contacts, of which a first set 5 includes five moving contacts 5A-C and corresponds to a rating of 250 A with a peak value of 50 to 75 kA, and a second set 5' includes twelve moving contacts 5A-F and corresponds to a rating of 1600 A with a peak value of 120 to 150 kA. The sets 5, 5' are symmetrical with respect to the centerline A of the cut-off device 1 and comprise one or two central moving contact(s) 5A, which are different from the other lateral moving contacts 5B-F. In the set of FIG. 3, the central moving contact 5A is centered on a centerline B and in the set of FIG. 4, the two central moving contacts 5A are symmetrical with respect to the centerline B. Each central moving contact 5A is larger and/or positioned ahead of the other ones in order to be the first to approach the fixed contacts 4 to establish the current, and the last to leave the fixed contacts 4 to cut off the current. It is subjected to the electric arc and therefore acts as a spark arrestor.

The lateral moving contacts 5B-C and 5B-F are made each of a conductive part having the shape of a metallic blade that is symmetrical with respect to the centerline A and provided laterally with two contact areas C. They may have identical dimensions or not. They are at least identical two by two symmetrically with respect to the centerline A.

The moving contacts 5A-C, 5A-F of a same set 5, 5' are carried by a carriage 8 object of the present invention. In the illustrated example, the carriage 8 comprises several separated and parallel seats 80, arranged for receiving the moving contacts 5A-C, 5A-F and insulating them from each other. Each moving contact is associated in its seat 80 with a return means 65, for example in the form of a compression spring, arranged to exert a determined pressing force on the moving contact when it is pressed against the fixed contacts 4 in the switched-on position. The seats 80 have different depths so that the lateral moving contacts 5B-C, 5B-F are offset two by two with respect to the protruding central moving contact 5A and form stages E1, E2, etc. The stroke from one stage to another may be equal or not.

The carriage 8 comprises an insulating support 81 in which the seats 80 are provided, as well as a supporting structure 9 surrounding the insulating support 81 to form around it a load-absorbing belt. In the represented example, the insulating support 81 is made of two superposed parts that define a body 82 in which the moving contacts 5A-C, 5A-F are seated, insulated from each other by the walls of the seats 80, with an axial freedom of movement, and a base 83 on the bottom of which the return means 65 are resting. The seats 80 extend between the base 83 and the body 82 and come out of said body laterally and symmetrically with respect to the centerline A to let the contact areas C stand out. The central seat 80 extends up to the front of the insulating support 81 taking into account the boss 50 that prolongs the central moving contact 5A in order to serve as a spark arrestor. The body 82 and the base 83 are held assembled by said supporting structure 9. Of course, any other embodiment of said insulating support 81 that would allow achieving the same functionality is conceivable.

In the represented example, the supporting structure 9 comprises a preferably metallic flat profile 90 extending over the lateral sides and on the rear of the insulating support 81 like a belt. It furthermore comprises a connecting part 91 in the form of a preferably metallic shaft passing through the insulating support 81 at the front and linked mechanically with the side ends of the profile 90 to close the belt. This connecting part 91 passes transversally through at least one of the seats 80 and preferably the central seat to rest against at least and preferably the central moving contact 5A, on the side opposite to its return means 65. The connecting part 91 forms a joint B2 that allows coupling the carriage 8 with the actuator mechanism 6 as explained below and thus transmits directly the driving efforts of said mechanism, in particular when switching off to open the electrical circuit, to the central mobile contact 5A that is the last leaving the fixed contact 4. Of course, any other embodiment of said supporting structure 9 that that would allow achieving the same functionality is conceivable.

In the represented example, the actuator mechanism 6 of the set 5, 5' of moving contacts comprises a drive shaft 60 linked in rotation with the handle 20 by means of a (non visible) angle transmission and/or controlled by a second (non represented) element fitted in the square bore 61. A system converting the rotary movement of the drive shaft 60 into a translation movement allows moving the carriage 8 along centerline A. This movement conversion system comprises a couple of jointed rods 62, 63, but any other equivalent means is conceivable. The first rod 62 is fixed to the drive shaft 60 and coupled in rotation with the second rod 63 by means of a first joint B1. The second rod 63 is coupled in rotation with the carriage 8 by a second joint B2 defined by the connecting part 91. The carriage 8 is guided in translation with respect to housing 30 by means of rails, ribs or any other equivalent means in which the protruding ends of the connecting part 91 that form the joint B2 or any other complementary shape are circulating.

This description shows clearly that the invention allows reaching the goals defined, in particular the design of the moving contact-carrying carriage allows dissociating the moving contacts insulation function from the mechanical resistance function of the carriage, and assigning them to two different but complementary parts, adapted to the assigned function as well in the choice of the materials as in their shape. The achieved result is an increase of the technical characteristics of such a carriage and of its lifetime, contributing favorably to prolong the endurance of the electrical cut-off device.

The present invention is not restricted to the examples of embodiment described, but extends to any modification and variant which is obvious to a person skilled in the art while remaining within the scope of the protection defined in the attached claims. The carriage of the invention has been described in reference to a multi-moving contact version, but it can also be provided for a single-moving contact version. In any case, it is necessary to provide one carriage per cut-off module or per phase.

The invention claimed is:

1. A contact carrying moving carriage (8), for an electrical cut-off device (1), comprising:

at least one seat (80) arranged in the moving carriage for receiving a moving contact (5) associated with a return mechanism (65), the at least one seat and the moving carriage both being movable relative to a fixed contact, and the moving carriage being coupled with an actuator mechanism (6) belonging to the device, wherein the moving carriage (8) comprises at least one insulating support (81) comprising the seat (80), and at least one supporting structure (9) surrounding the insulating support (81) so as to form around it a load-absorbing belt.

2. The carriage according to claim 1, wherein the supporting structure (9) comprises at least one connecting part (91) coupling the carriage (8) with the actuator mechanism (6) belonging to the device.

3. The carriage according to claim 2, wherein the connecting part (91) is positioned in a front section of the insulating support (81) and passes transversely through the seat (80) so as to rest on the moving contact (5), on a side opposite to the return mechanism (65), when the moving contact is mounted in the carriage.

4. The carriage according to claim 3, wherein the supporting structure (9) comprises furthermore a metallic profile (90) which extends over lateral sides and along a rear of the insulating support (81), and the connecting part (91) comprises at least one metallic shaft passing through the insulating support (81) and sides of the metallic profile (90).

5. The carriage according to claim 1, wherein the insulating support (81) comprises at least two superposed parts, among which a body (82) on which the moving contact (5) is seated, and a base (83) on which the return mechanism (65) is at least partly seated, and the seat (80) extending from the body to the base.

6. The carriage according to claim 1, wherein the carriage comprises several seats (80) arranged in parallel to accommodate several moving contacts (5A-C, 5A-F) which are insulated from one another.

7. The carriage according to claim 6, wherein the seats (80) have different depths so as to offset the moving contacts (5A-C, 5A-F) in space.

8. The carriage according to claim 7, wherein the carriage is symmetrical with respect to a centerline (B), and the seats (80) are offset, two by two, symmetrically with respect to the centerline so as to form stages.

9. An electrical cut-off device (1) provided with a control module (2) associated with at least one cut-off module (3) corresponding to a phase of an electrical network, the cut-off module comprising:

at least one moving contact (5) associated with at least one pair of fixed contacts (4), the moving contact (5) being carried by a moving carriage (8) coupled with an actuator mechanism (6) controlled by the control module (2) so as to be movable between at least one switched-off position, in which the moving contact is spaced from the fixed contacts and the electrical circuit is open, and a switched-on position, in which the moving contact is resting on the pair of fixed contacts and the electrical circuit is closed, and the moving carriage comprising at least one seat to accommodate the moving contact which is associated with a return mechanism, wherein the moving carriage (8) comprises at least one insulating support (81) comprising the seat (80), and at least one supporting structure (9) surrounding the insulating support (81) so as to form a load-absorbing belt around the insulating support (81).

10. The device according to claim 9, wherein the supporting structure (9) comprises at least one connecting part (91) arranged for coupling the carriage (8) with the actuator mechanism (6).

11. The device according to claim 10, wherein the connecting part (91) is positioned in a front section of the insulating support (81) and passes transversely through the seat (80) in order to rest on the moving contact (5) on a side opposite to the return mechanism (65).

12. The device according to claim 11, wherein the supporting structure (9) comprises at least a metallic profile (90) extending over lateral sides and along a rear of the insulating support (81) and the connecting part (91) comprises at least one metallic shaft passing through the insulating support (81) and side of the metallic profile (90).

13. The device according to claim 9, wherein the insulating support (81) comprises at least two superposed parts, among which ,a body (82) on which the moving contact (5) is seated, and a base (83) on which the return mechanism (65) is at least partly seated, and the seat (80) extending from the body to the base.

14. The device according to claim 9, wherein it comprises at least one set (5, 5') of several moving contacts (5A-C; 5A-F) associated with the pair of fixed contacts (4), and in that the carriage (8) comprises several parallel seats (80) to accommodate the moving contacts insulated from each other.

15. The device according to claim 14, wherein the seats (80) have different depths so as to offset the moving contacts in space with respect to each other so as to stagger in time the approach of the moving contacts on the fixed contacts when closing the electrical circuit.

16. The device according to claim 15, wherein the set (5, 5') comprises at least one central moving contact (5A) that is ahead of the other moving contacts (5B-C; 5B-F) arranged laterally around the central moving contact (5A), so that it is the first to establish the current when closing the electrical circuit and the last to cut off the current when opening the circuit, and in that the connecting part (91) of the carriage (8) is in direct contact with the central moving contact (5A) to transmit it directly the driving efforts of the actuator mechanism (6) when opening the electrical circuit.

17. The device according to claim 14, wherein the carriage (8) is symmetrical with respect to a centerline (B), and in that the seats (80) are offset two by two symmetrically with respect to the centerline so as to form stages.

18. A carrying moving carriage for moving contacts for an electrical cut-off device, the carrying carriage comprising:

at least one insulating support comprising at least one seat, the at least one seat and the moving carriage both being movable relative to a fixed contact;

the moving carriage being coupled to an actuator mechanism of the cut-off device which biases a moving contact with respect to the fixed contact between an off position and an on position, such that in the off position the moving contact is spaced from the fixed contact so as to open an electrical circuit, and in the on position the moving contact abuts the fixed contact so as to close the electrical circuit;

the moving contact being supported in the at least one insulating support such that he moving contact is received within the at least one seat;

the moving contact communicates with a return mechanism which exerts a force on the moving contact when the moving contact abuts the fixed contact in the on position; and at least one supporting structure comprising an elongate profile which encircles the at least one insulating support to form a load-absorbing belt around the at least one insulating support.

19. The carriage according to claim 1, wherein the moving carriage (8) is movable with respect to a housing of the electrical cut-off device (1), and the moving contact is movable with respect to both the housing and the moving carriage (8).

* * * * *